United States Patent [19]

Daggett

[11] 4,432,594

[45] Feb. 21, 1984

[54] CLIP-TOGETHER INTERCONNECTION BUSING CLIP FOR MULTIPLE FUSE HOLDER ARRAYS

[75] Inventor: Charles W. Daggett, Mt. Prospect, Ill.

[73] Assignee: Littelfuse, Inc., Des Plaines, Ill.

[21] Appl. No.: 307,367

[22] Filed: Oct. 1, 1981

[51] Int. Cl.[3] ..... H01R 13/12

[52] U.S. Cl. ..... 339/258 F; 339/262 F

[58] Field of Search ..... 339/19, 198 R, 198 G, 339/198 GA, 198 H, 198 K, 222, 252 F, 253 F, 258 F, 259 F, 262 F

[56] References Cited

U.S. PATENT DOCUMENTS 3,813,637 5/1974 Grebik et al. ..... 339/59 R
4,082,408 4/1978 Angelis ..... 339/198 H

FOREIGN PATENT DOCUMENTS 2058922 6/1972 Fed. Rep. of Germany ... 399/198 G
2407577 6/1979 France ..... 339/222

*Primary Examiner*—Joseph H. McGlynn
*Attorney, Agent, or Firm*—Wallenstein, Wagner, Hattis, Strampel & Aubel

[57] ABSTRACT

A fuse holder clip for snap-in insertion into a parallel array fuse holder block features a terminal lug configured in the form of a right-angle strap of length such as to allow mechanical and electrical engagement to a similarly configured adjacent clip disposed along one side of the array. Complementary engaging means, preferably in the form of a hollow rivet at the right-angle bend of the strap, and a matching hole at the outboard end of the strap permits riveting engagement of an arbitrary number of such clips, whereby such clips become electrically interconnected by a common bus. The snap-in feature of the clips permits removal and reconfiguration of terminal groupings along a given edge of the fuse block at will. Use of the hollow rivet facilitates high current lead attachment to the bus by an eyelet lead lug and a self-tapping screw. A support shelf unitary with the mounting block and disposed to give close support to the junction region of the two straps prevents significant deformation of the bus during such lead attachment. The shelf also provides additional protection against accidental deformation of the bus structure to touch the mounting surface on which the fuse block is mounted.

21 Claims, 13 Drawing Figures

FIG. 1A
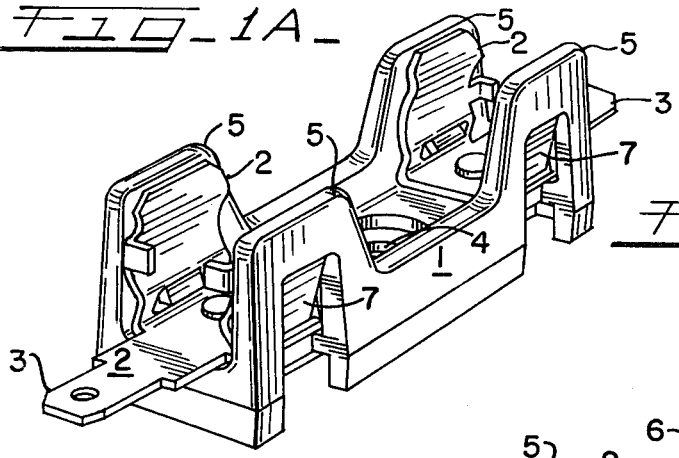
FIG. 2
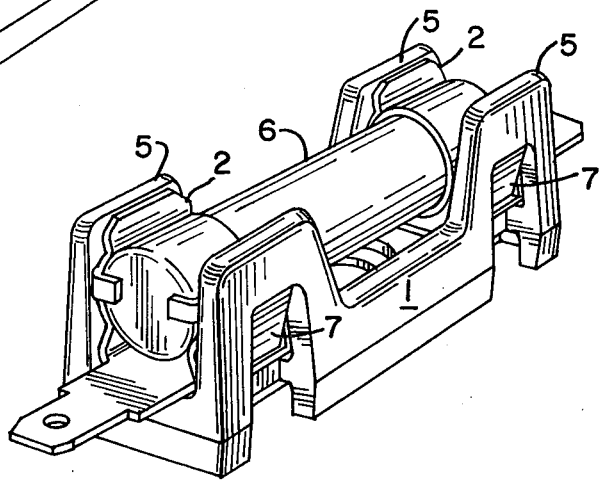
FIG. 1D
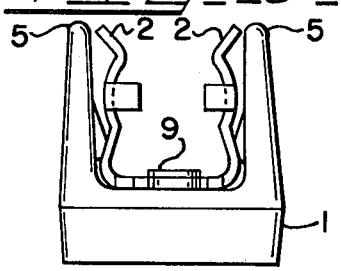
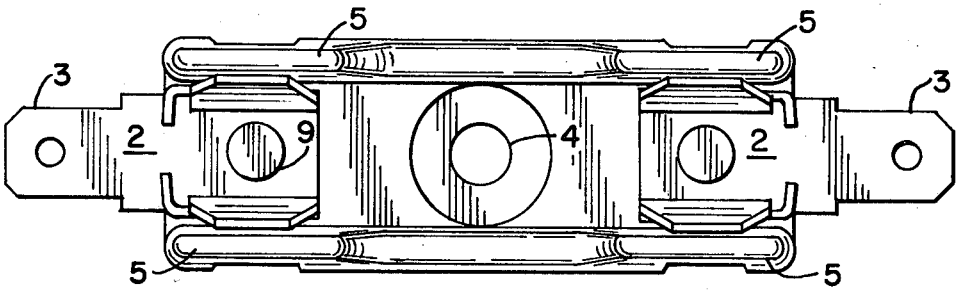
FIG. 1B
FIG. 1C
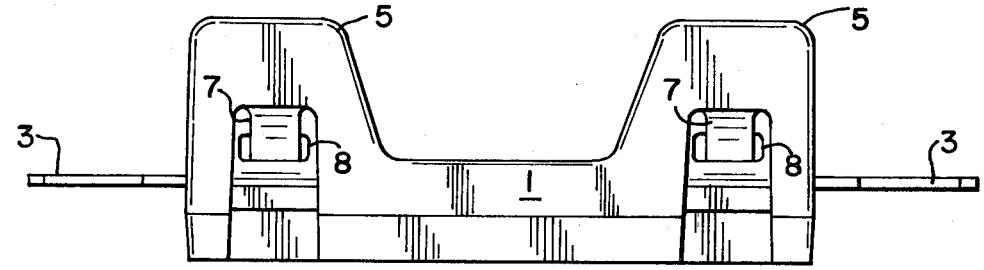

FIG. 6A
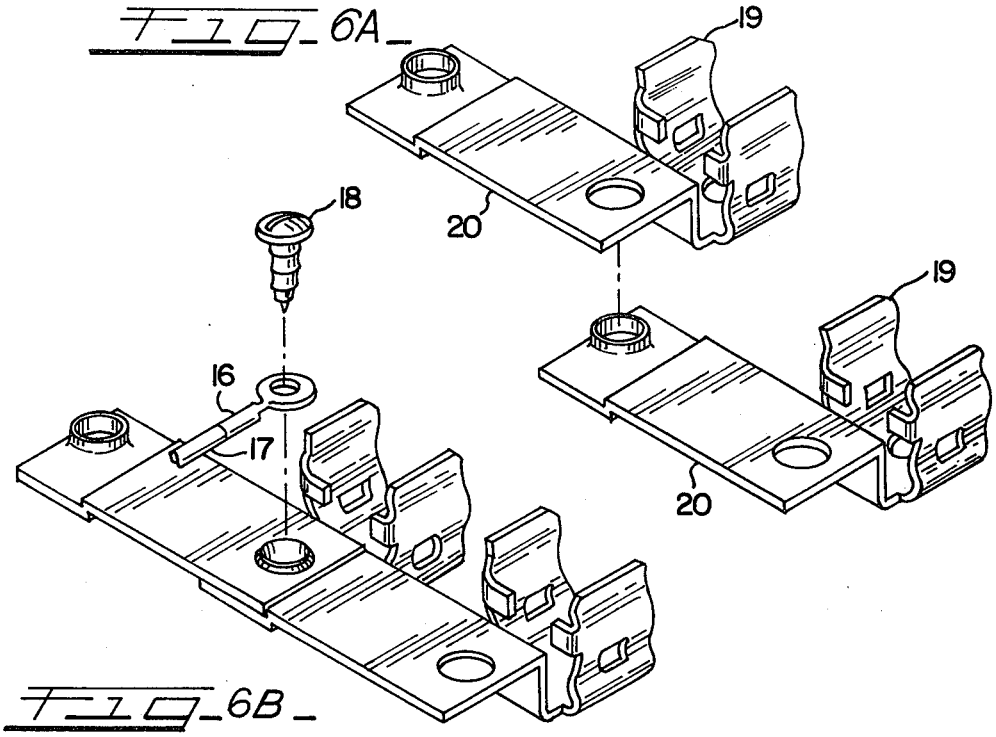
FIG. 6B
FIG. 6C
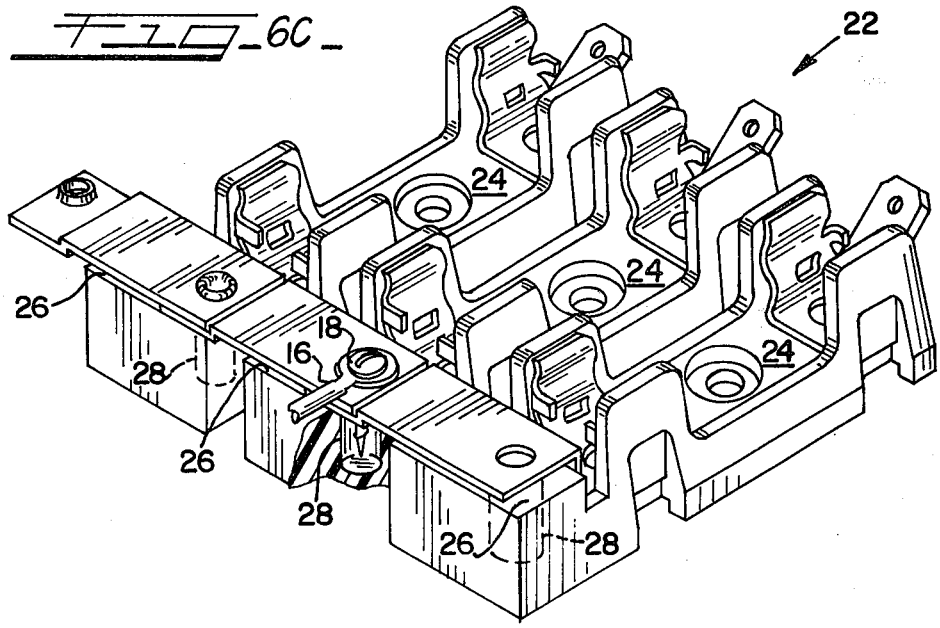

CLIP-TOGETHER INTERCONNECTION BUSING CLIP FOR MULTIPLE FUSE HOLDER ARRAYS

TECHNICAL FIELD

The subject matter of the invention is an improved interconnection busing clip for arrays of cartridge-type electrical fuses.

BACKGROUND OF PRIOR ART

Conventional clip-in fuse holders for cylindrical cartridge fuses exhibit certain deficiencies with respect to terminal interconnection methods. Such holders typically consist of a pair of spring clips mounted on a base and configured to engage the end terminals of a cylindrical cartridge fuse by pressing insertion. The clips, together with unitary or separate terminal lugs, are normally secured to the base by a metallic rivet passing through a hole in the clip base and through a matching hole passing through the mounting base. Such riveted fuse mounts when fabricated in the form of arrays of parallel individual fuse holders frequently require one or more bus elements to inter-connect preselected groups of common fuse terminals, as for example by a common ground strap. These are typically fashioned in the form of a perforated strap to be held in contact with the chosen clips by the rivets. Where the chosen common terminals are adjacent, the bus typically takes the form of a perforated strap with uniform hole spacing. If the common terminals are not adjacent, or if there are short insulating barrier walls between them, the bus must be configured with right-angle tabs. For limited production runs of such arrays the cost of fabricating uniquely configured buses can significantly add to the manufacturing costs. Moreover, riveted buses cannot be modified without substantial disassembly of the array. Accordingly, it is an object of the invention to provide an easily engaged and removed busing means that can be readily configured to engage selected clips along a given side of such an array.

It is a further object of the invention to provide such busing means in a form such that high current lead wires may be easily and reliably attached to such a busing means.

BRIEF SUMMARY OF INVENTION

According to the invention, a snap-in fuse clip configured for locking pressure insertion on a suitably configured fuse array mounting base is provided with a specially configured integral terminal lug designed for mutual mechanical and electrical engagement with similarly configured neighboring clips. Groups of such clips may be interconnected either before or after insertion of clips on the mounting base to form a common busing means between chosen terminal groupings. Configurations may be selected at will at the user's option for initial assembly. Alternatively, an assembled grouping may be replaced or modified after assembly to facilitate busing modification at minimal expense and in very little time. The principal deficiency of conventional riveted strap interconnection buy systems is overcome, since such riveted structures are typically uneconomical to reconfigure, requiring demounting and at least partial disassembly thereof.

According to a specific feature of the invention, the busing clips are fabricated in the form of right-angle straps with a post at the angle portion and a hole at the outboard end of the strap. Strap length is adjusted to place the hole in one strap in overlapping matching engagement with the post of its neighbor, whereby a string of such straps may be joined in a common busing string simply by cold-forming the posts to the holes.

According to a specific feature of the invention, hollow posts are employed. By this means a relatively thick metal collar is presented for high torque engagement with a self-tapping screw used to connect an external electrical lead to the strap for high current service.

According to a specific feature of the invention, the outboard end of the strip in the region of the hole is parallel offset by an amount equal to the strap thickness to maintain overall coplanarity of the bus and the bases of the associated clips.

According to a specific feature of the invention, the mounting base is provided with a system of shelves disposed to provide local support to each strap below the post to facilitate the high torque engagement of the self-tapping screw.

Other objects, advantages, and features of the invention will become apparent upon making reference to the description to follow, the drawings, and the claims.

BRIEF DESCRIPTION OF DRAWINGS

FIGS. 1A, 1B, 1C, and 1D show various views of a single fuseholder featuring snap-in fuse mounting clips;

FIG. 2 is a perspective view of the fuseholder of FIG. 1 with a fuse inserted;

FIGS. 6A and 6B are a perspective view of an alternative version of busing clips wherein the common strap is disposed in a plane above the clip base planes.

FIG. 6C shows the busing structure shown in 6A in position of a modified fuseholder array, wherein a special shelf provides local support to the bus immediately around the hollow posts.

DETAILED DESCRIPTION OF THE INVENTION

Figure 3:
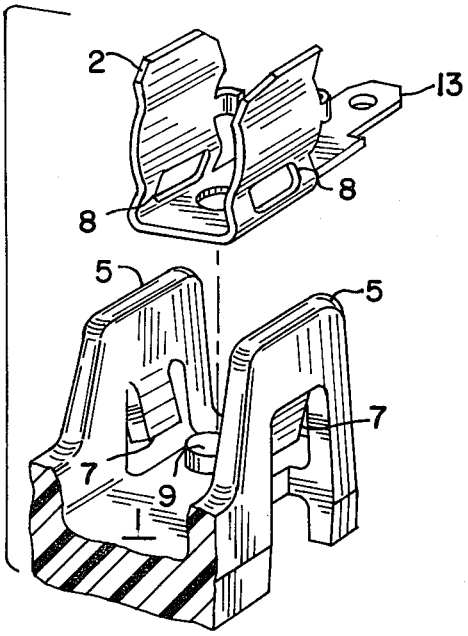
FIG. 3 is a sectional exploded perspective view of one end of the fuseholder of FIG. 1A showing details of the snap-in engagement of a fuseholder clip.

The present invention deals with an insertable interconnectable fuse clip for use with fuseholders of the general type disclosed by Daggett and Nemeth in an application entitled "Fuse Holder Block" (Ser. No. 293,605, filed Aug. 17, 1981) and assigned to the same assignee as the present application. Such fuseholders feature a unitary mounting base with compliant unitary engaging means for engaging and securing fuse clips pressed into snap-in engagement during assembly. Conventional riveting operations used to secure clips to bases are thereby eliminated. FIGS. 1*a*, 1*b*, 1*c*, and 1*d* show various views of such a single fuseholder in the assembled form. FIG. 2 shows such a holder with a fuse inserted. FIG. 3 shows one form of snap-in engagement for a fuse clip 2 with clip base 1. The clip 2 is pressed downward over the capture post 9 to force engaging tabs 7 outward as the clip is pressed down over the post, whereupon engaging tabs 7 spring inward to engage locking slots 8 in the sides of the clip. Unitary connecting lugs 3 are provided for electrical connection.

Figure 4:
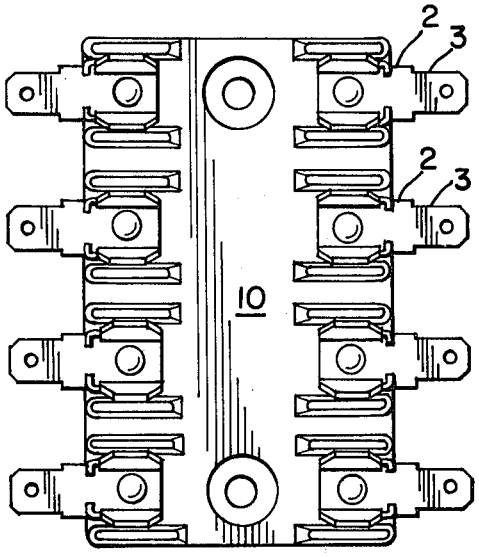
FIG. 4 is a plan view of a simple array of isolated individual fuseholders of the type shown in FIG. 1.

Such fuseholders may similarly be formed in array form as shown in FIG. 4, wherein a group of four fuseholders is mounted on a common base 10. The subject matter of the present invention is to provide a convenient interconnection means for interconnecting a chosen group of terminals along a given side by means of a common bus. The subject matter of the invention consists of specially fabricated fuse clips configured for locking engagement into groups of a chosen size which are then simultaneously pressed into their appropriate locations on a block such as that of FIG. 4.

Figure 5A:
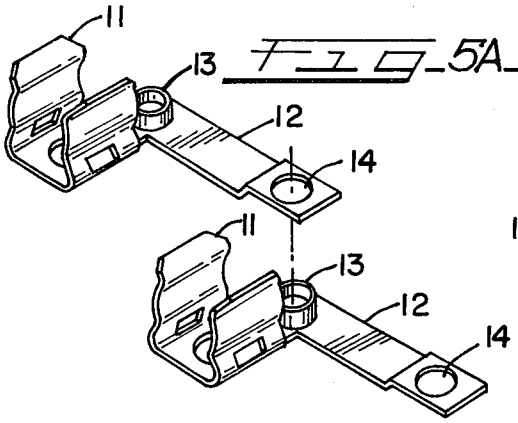
FIG. 5A is a perspective view of two busing clips positioned for assembly.
Figure 5B:
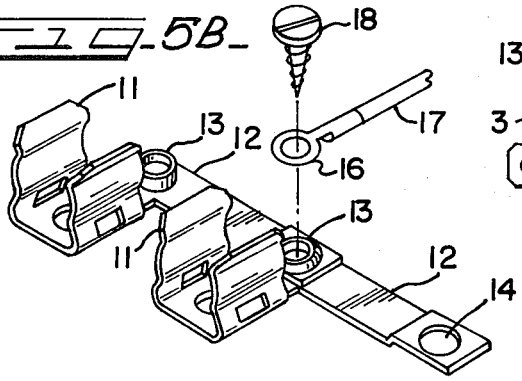
FIG. 5B is a perspective view of the pair of clips shown in FIG. 5A after assembly, and shows in exploded view the use of a formed hollow post as a fastening means for a high current lead.

FIG. 5*a* shows a pair of modified fuse clips 11 ready for interconnection. The base engaging end of each clip is configured as shown in FIG. 3, with the outboard end of each clip consisting of a right-angled strap 12. Centrally located at the strap angle is a portion of an engaging means preferably in the form of an integral eyelet post 13, and at the strap end is a matching engaging means preferably in the form of a centrally located hole 14 configured to acceptingly engage the eyelet post. By placing one eyelet post 13 as in FIG. 5*a* through the end hole 14 of a similar fuse clip and cold forming the end of the eyelet protruding through the hole, a rigid mechanically and electrically interconnected structure is obtained, as shown in FIG. 5*b*. The end of strap 12 carrying the end hole 14 is offset as shown to preserve coplanarity of the bases of the assembled clips 11 (FIG. 5B). The right-angle portion of the fuse clips of FIG. 5*a* may be of arbitrary length, with the only restriction that the post-to-hole distance of each clip be set at an integer multiple of the fuse separation distance on the mounting block. In FIG. 5B a group of two interconnected fuse clips is shown, however, any arbitrary number of fuse clips may be so interconnected.

Figure 5C:
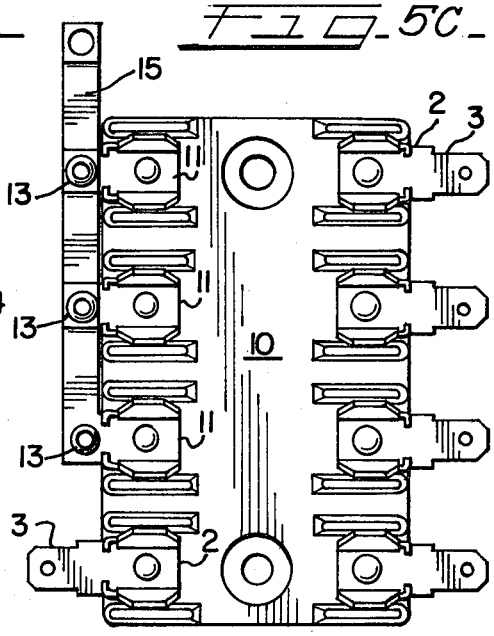
FIG. 5C is a plan view of an assembled array similar to that of FIG. 4, but wherein three terminals have been interconnected.

FIG. 5C shows a group of three such fuse clips interconnected before assembly by the methods indicated in FIG. 5B and subsequently pressed into snap-in engagement with an array block 10 to form a group of three interconnected terminals. Referring to 5C, it is clear that external electrical connection may be made to any one of four points on the bus, namely any of the three hollow eyelet posts 13, or to the hole 14 at the end of strap 12. Where desired, the remaining extended end 15 of the strap may be cut away in the interest of saving space. The hollow eyelets are particularly suited to high current external lead connection, since they present an additional thickness of metal for high torque engagement with self-tapping screws, as shown schematically in FIG. 5B. An eyelet terminal lug 16 attached to a lead 17 may be secured to bus eyelet 13′ by a self-tapping screw 18. Such a busing structure has the further advantage that it is, in contrast to conventional riveted buses, readily reconfigurable by removing a chosen interconnected group of clips and either replacing with individual clips or with an interconnected bus of different configuration. FIGS. 6A and 6B show a preferred form of busing clip 19 wherein the busing straps 20 are disposed offset and elevated above the clip bases. A modified fuse holder array 22 consists of modified individual fuse holders 24, each of which is provided with a support shelf 26 forming a common plane. The height of the shelves 26 is disposed such that when the assembled clips are inserted, each shelf 26 forms a local support immediately under each hollow post 30. Each shelf 26 is provided with a corresponding recess 28 to accommodate an inserted metal tapping screw 32 employed for lead attachment as previously described. When the lead attaching screw 32 is screwed into the hollow post 30 under high torque conditions to insure adequate low resistance contact, the strap element 20 receives direct support from the shelf 26, thereby preventing deformation and possible destruction of the strap during the lead attachment process. Such a system of shelves also serves to prevent accidental deformation of the straps into close or touching proximity to the mounting surface on which the fuse holder array is mounted.

Such busing clips are readily manufactured by conventional means, are inexpensive, and lend themselves to a wide variety of arbitrary interconnection configurations, and do not require the drilling out of rivets to reconfigure the common terminals, as is the case with conventional riveted strap bus structures. The snap-in engagement shown in FIG. 5 is not restricted to designs such as that in FIG. 3, but is applicable to any type of fuse clip that is mountable to a supporting base by snap-in engagement.

While for the purpose of illustration, various forms of this invention have been disclosed, other forms thereof may become apparent to those skilled in the art upon reference to this disclosure and, therefore, this invention shall be limited only by the scope of the appended claims.

I claim:

1. A fuse holder array for cartridge type electrical fuses comprising:

a mounting base;

a plurality of spring clips, each said clip including a pair of clip jaws for springingly lockingly engaging a terminal of an inserted fuse, each said clip having unitary terminal lug means; and means for securing said clips to clip mounting areas on said base, said secured clips disposed in two parallel rows to form a parallel array of engaged inserted fuses, a chosen plurality of said clips along a given row having their associated termal lug means configured as busing terminals integral with said clips and configured in the form of right-angle conductors comprising a first portion extending away from said clip and a second portion extending at right angles to said first portion such that said second portions of said associated terminal lug means lie substantially along a common axis, each said first portion including an identical first engaging means formed integrally therewith, each said second portion including an identical second engaging means formed integrally therewith, said first engaging means being configured to lockingly engage with said second engaging means by mutal engagement therebetween solely by mechanical deformation of at least one of said engaging means, said first engaging means being disposed at the outer end of said first portion, said second engaging means being disposed at the distal end of said second portion, the length of each said second portion being configured to engagingly join said chosen plurality of clips as a common busing element with said chosen plurality of clips secured to their respective mounting areas.

2. The fuse holder array of claim 1 wherein said first and second portions are configured as substantially coplanar straps.

3. The fuse holder of claim 1 wherein said mounting base includes at least one insulating shelf disposed to lie between a portion of at least one of said lug means of a clip secured to said base and a surface to which said mounting base is mounted, and disposed to form an insulating barrier preventing said first and second portions of said at least one lug means from contacting said mounting surface.

4. The fuse holder array of claim 3 wherein said shelf includes a pedestal portion extending down to said mounting surface to provide mechanical support for said shelf.

5. The fuse holder array of claims 1 or 3 wherein said means for securing said clips includes portions of said base and portions of said clips configured for snap-in engagement when said clips are pressed into contact with said clip mounting areas.

6. The fuse holder of claim 3 wherein said first and said second portions are configured as substantially coplanar straps.

7. The fuse holder array of claim 6, wherein said at least one shelf is disposed in close proximity to at least one chosen point of external lead attachment to said at least one lug member.

8. The fuseholder array of claim 7, wherein a portion of at least one of said first or said second engagement member constitutes at least a portion of a means for external lead attachment.

9. A fuse holder array for cartridge type electrical fuses comprising:

a mounting base;

a plurality of spring clips, each said clip including a pair of clip jaws for springingly lockingly engaging a terminal of an inserted fuse, each said clip having a unitary terminal lug means; and means for securing said clips to clip mounting areas on said base, said secured clips disposed in two parallel rows to form a parallel array of engaged inserted fuses, a chosen plurality of said clips along a given row having their associated termal lug means configured as busing terminals in the form of right-angle conductors comprising a first portion extending away from said clip and a second portion extending at right angles to said first portion such that said second portions of said associated terminal lug means lie substantially along a common axis, said first and second portions being configured as substantially coplanar straps, each said first portion including an identical first engaging means, each said second portion including an identical second engaging means, said first engaging means configured to lockingly engage said second engaging means, said first engaging means being disposed at the outer end of said first portion, said second engaging means being disposed at the distal end of said second portion, the length of each said second portion configured to engagingly join said chosen plurality of clips as a common busing means with said chosen plurality of clips secured to their respective mounting areas, and wherein each said first engaging means comprises an upright post unitary with said busing terminal and disposed centrally in the junction region between said first and second portions, and said second engaging means comprises a portion of said distal end configured with a hole therethrough to accept passage of said post through said hole, said post configured substantially longer than said hole through said distal end to allow crowning deformation engagement of said post to said second portion.

10. The fuse holder array of claim 9 wherein said post has an axial passageway entering the top thereof.

11. The fuse holder array of claim 10 wherein said post comprises at least a portion of said means for external lead attachment.

12. The fuse holder array of claim 10 wherein said second portion is configured with said distal end offset by a displacement equal to the thickness of said second portion to dispose the remaining regions of said first and second portions substantially mutually coplanar among said chosen plurality after securing said chosen plurality to said mounting areas.

13. A fuse holder array for cartridge type electrical fuses comprising:

a mounting base;

a plurality of spring clips, each said clip including a pair of clip jaws for springingly lockingly engaging a terminal of an inserted fuse; each said clip having a unitary terminal lug member; and means for securing said clips to clip mounting areas on said base, said secured clips disposed in two parallel rows to form a parallel array of engaged inserted fuses, a chosen plurality of said clips along a given row having their associated termal lug members configured as busing terminals in the form of right-angle conductors comprising a first portion extending away from said clip and a second portion extending at right angles to said first portion such that said second portions of said associated terminal lug members lie substantially along a common axis, said first and second portions being configured as substantially coplanar straps, each said first portion including an identical first engaging means, each said second portion including an identical second engaging means, said first engaging means configured to lockingly engage said second engaging means, said first engaging means being disposed at the outer end of said first portion, said second engaging means being disposed at the distal end of said second portion, the length of each said second portion configured to engagingly join said chosen plurality of clips as a common busing means with said chosen plurality of clips secured to their respective mounting areas, said mounting base including at least one insulating shelf disposed to lie between a portion of at least one of said lug means of a clip secured to said base and a surface to which said mounting base is mounted, and disposed to form an insulating barrier preventing said first and second portions of said at least one lug means from contacting said mounting surface, said at least one shelf being disposed in close proximity to at least one chosen point of external lead attachment to said at least one lug means, a portion of at least one of said first or said second engagement means constituting at least a portion of a means for external lead attachment; and wherein each said first engaging means comprises an upright post unitary with said busing terminal and disposed centrally in the junction region between said first and second portions, and said second engaging means comprises a portion of said distal end configured with a hole therethrough to accept passage of said post through said hole, said post configured substantially longer than said hole through said distal end to allow crowning deformation engagement of said post to said second portion, said post having an axial passageway entering the top thereof, said hollow post comprising said at least a portion of said means for external lead attachment.

14. The fuse holder array of claim 13 wherein said axial passageway extends the length of said post and through said junction region, and said shelf is configured with a recess to clearingly accept external lead attachment means passing through said passageway.

15. The fuse holder array of claim 14 wherein said second portion is configured with said distal end offset by a displacement equal to the thickness of said second portion to dispose the remaining regions of said first and second portions substantially mutually coplanar among said chosen plurality after securing said chosen plurality to said mounting areas.

16. A fuse holder clip configured to be secured to a mounting base as an element of an array of similar fuse holder clips disposed with parallel engagement axes for inserted fuses, each said clip comprising terminal lug means integrally formed with said clip, said terminal lug means configured as a busing terminal in the form of a right-angle conductor comprising a first portion extending away from said clip and second portion extending at right angles to said first portion and at right angles to the fuse engagement axis of said clip, said first portion including a first engagement means formed integrally therewith and disposed at the outer end of said first portion, said second portion including a second engagement means formed integrally therewith and disposed at the distal end of said second portion, said first and second engagement means being configured for mutual locking engagement solely by mechanical deformation of at least one of said engaging means, the length of said second portion being configured to engagingly join a similar neighboring clip secured to said mounting base so as to form a common terminal busing means with said neighboring clip.

17. The fues holder clip of claim 16 wherein said clip is configured to be secured to said mounting base by snap-in engagement of portions of said clip with matching portions of said mounting base.

18. The fuse holder clip of claim 16 wherein said first and second portions are configured as substantially coplanar straps.

19. A fuse holder clip configured to be secured to a mounting base as an element of an array of similar fuse holder clips disposed with parallel engagement axes for inserted fuses, each said clip comprising terminal lug means unitary with said clip, said terminal lug means configured as a busing terminal in the form of a right-angle conductor comprising a first portion extending away from said clip and a second portion extending at right angles to said first portion and at right angles to the fuse engagement axis of said clip, said first and second portions being configured as a substantially coplanar strap, said first portion including a first engagement means disposed at the outer end of said first portion, said second portion including a second engagement means disposed at the distal end of said second portion, said first and second engagement means configured for mutual locking engagement, the length of said second portion configured to engagingly join a similar neighboring clip secured to said mounting base so as to form a common terminal busing means with said neighboring clip, and wherein each said first engaging means comprises an upright post unitary with said busing terminal and disposed centrally in the junction region between said first and second portions, and said second engaging means comprises a portion of said distal end configured with a hole therethrough to accept passage of said post through said hole, said post being configured substantially longer than said hole through said distal end to allow crowning deformation engagement of said post to said second portion.

20. The fuse holder clip of claim 19 wherein said post has an axial passageway entering the top thereof.

21. The fuse holder clip of claim 20 wherein said second portion is configured with said distal end offset by displacement equal to the thickness of said second portion to dispose the remaining regions of said first and second portions substantially mutually coplanar with said first and second portions of an engaged similarly configured clip.

* * * * *